United States Patent [19]

Zwahlen

[11] 4,056,215

[45] Nov. 1, 1977

[54] ANTI-BRIDGING DEVICE

[75] Inventor: Ernst Zwahlen, Uster, Switzerland

[73] Assignee: Elex A.G., Zurich, Switzerland

[21] Appl. No.: 679,883

[22] Filed: Apr. 26, 1976

[51] Int. Cl.[2] ..... B65G 3/12

[52] U.S. Cl. ..... 222/231; 198/533

[58] Field of Search ..... 222/197, 231; 221/200; 55/430; 198/533

[56] References Cited

U.S. PATENT DOCUMENTS

| | | | |
|---|---|---|---|
| 1,348,414 | 8/1920 | Heberling | 222/231 X |
| 1,537,123 | 5/1925 | Leopold | 222/231 X |
| 2,603,307 | 7/1952 | Richardson | 55/430 X |
| 2,710,117 | 6/1955 | Fritz et al. | 222/231 X |
| 2,953,199 | 9/1960 | Kohlins et al. | 55/430 |
| 3,161,464 | 12/1964 | Andersson et al. | 55/430 |

*Primary Examiner*—Robert B. Reeves
*Assistant Examiner*—David A. Scherbel

[57] ABSTRACT

Anti-bridging device for a hopper having an upper inlet portion and a lower outlet portion with sidewalls disposed therebetween, the anti-bridging device including at least one anti-bridging member movably attached to one sidewall of the hopper with cooperating elements to raise and lower the anti-bridging member. The cooperating elements for raising and lowering the anti-bridging member are generally an endless belt having at least one upwardly extending member which contacts the anti-bridging member during movement of the belt.

6 Claims, 2 Drawing Figures

ANTI-BRIDGING DEVICE

BACKGROUND OF THE INVENTION

Figure 2:
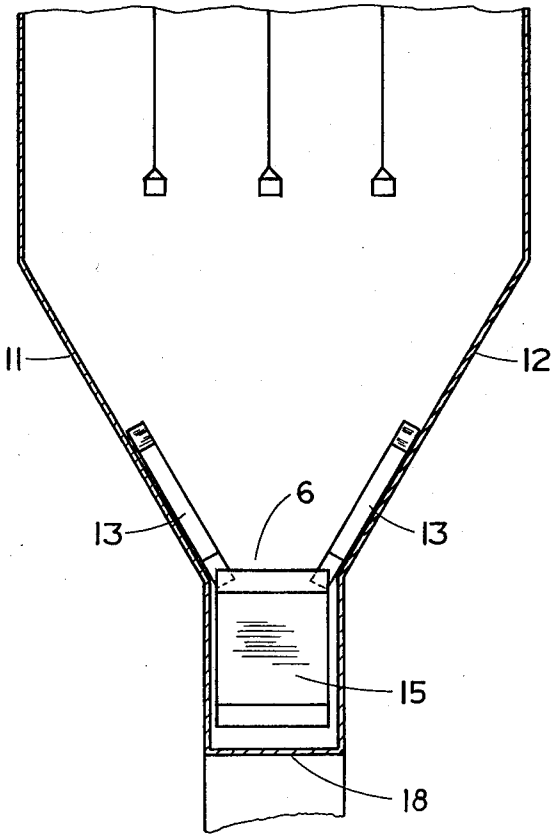

The invention relates to an anti-bridging device for a hopper and more particularly to a device for preventing bridging of material in a hopper for the discharge from electrostatic precipitators.

Bridge building across discharge outlets in hoppers or bins for bulk goods have for a long period of time presented problems to those artisans working in solids handling materials. Many different approaches have been taken in order to alleviate or to destruct the bridge in the aforementioned hoppers and bins. For example, rods or rakes which are set through spickets located in the hopper walls have been applied. However, in these type of devices the efficiency of the operation cannot be checked optically and the employment of personnel is generally considerable. Furthermore, for gas tight precipitators, stuffing boxes have to be used which means relatively high cost and increases the danger of dust build-up on internal hopper wall.

Chains, rods, cables and the like have been installed inside hoppers wherein the chains, rods, cables and the like have been mechanically moved in order to destroy the bridges. However, the installation of these type of devices in large hoppers have been quite expensive and it has also been found that the suspension of these elements at the hopper walls means additional points for bridge building. External vibrating or rapping of the hoppers have also been utilized, but in many cases bridges have not been destroyed and in some instances compaction of the solid materials has occurred. Utilization of air to pressurize the bridging areas has also been tried with limited success, but in many instances air is undesirable when explosive gases are being treated in electrostatic precipitators, and in order to alleviate this, the utilization of a special inert gas has proved to be expensive.

In other cases internal hopper walls have been lined with special materials which diminish the co-efficient of friction between the dust and the hopper wall. However, in many instances during the heat-up of the installation, particularly in electrostatic precipitators, the humid and sticky dust layer builds up on the lining, the results thereby negating the low co-efficient of friction anticipated between the dust and the hopper walls. In even other cases, hopper walls have been heated since it is well known that hot and dry dust is less adherent than humid dust. However, this has proved to be quite expensive in big hoppers and also in some instances there has been a dangerous reaction between hot dust and oxygen through this type of method of preventing bridge build-ups.

SUMMARY OF THE INVENTION

In the present invention, it is recognized that it is desirable to provide a means for preventing the build-up of solid materials on the sides of hopper walls, and, particularly inclined hopper sidewalls.

In the present invention, the prevention of build-up of materials is generally accomplished by movable attaching anti-bridging members to hopper sidewalls wherein the anti-bridging members are movable upon contact by at least one upwardly extending member attached to an endless movable belt means. However, it is realized that other conveying means having upwardly extending members for contacting anti-bridging members, such as screw conveyors and other mechanical dust moving devices, may be used. The anti-bridging members are normally rectangular in shape and hinged at one of the upper corners for pivotal movement upon contact by the moving upwardly extending member. The rectangularly shaped members usually include a tongue at the lower corner opposed to or diagonally from the upper pivoted corner wherein the tongue is specifically designed in combination with the upwardly extension member to lift the anti-bridging member a preselected height upon contact with the moving upwardly extending member. After the anti-bridging member has moved a preselected height and the upwardly extending member has passed underneath, the anti-bridging member then drops back down wherein the upward and downward movement of the anti-bridging member dislodges any dust bridges formed. The upward and downward movement of the anti-bridging member is determined by the speed of the endless belt as well as the number of upwardly extending members which contact the anti-bridging member. In the use of large hoppers, a plurality of anti-bridging members may be used on each of the sidewalls at the preselected portions where bridges are most likely to form. Furthermore, depending upon the requirements and efficiency of the anti-bridging devices, the drive of the cams can be effected from outside or from inside the hopper. The later has been found to be the most useful when the contact between the atmosphere and the hopper content must be avoided. In addition, utilization of an internal drive causes less sealing problems.

Various other features of the present invention will become obvious to those skilled in the art upon reading the disclosure set forth hereinafter.

More particularly, the present invention provides a device for preventing bridging in a hopper, the hopper including an upper inlet portion and a lower outlet portion with sidewalls disposed therebetween, the device comprising: at least one anti-bridging member movably attached to one sidewall of a hopper; and, dust moving means having at least one upwardly extending member, the upwardly extending member contacting the anti-bridging member during movement of the dust movement means.

It is to be understood that the description of the examples of the present invention given hereinafter are not by way of limitation. Various modifications within the scope of the present invention will occur to those skilled in the art upon reading the disclosure set forth hereinafter.

Figure 1:
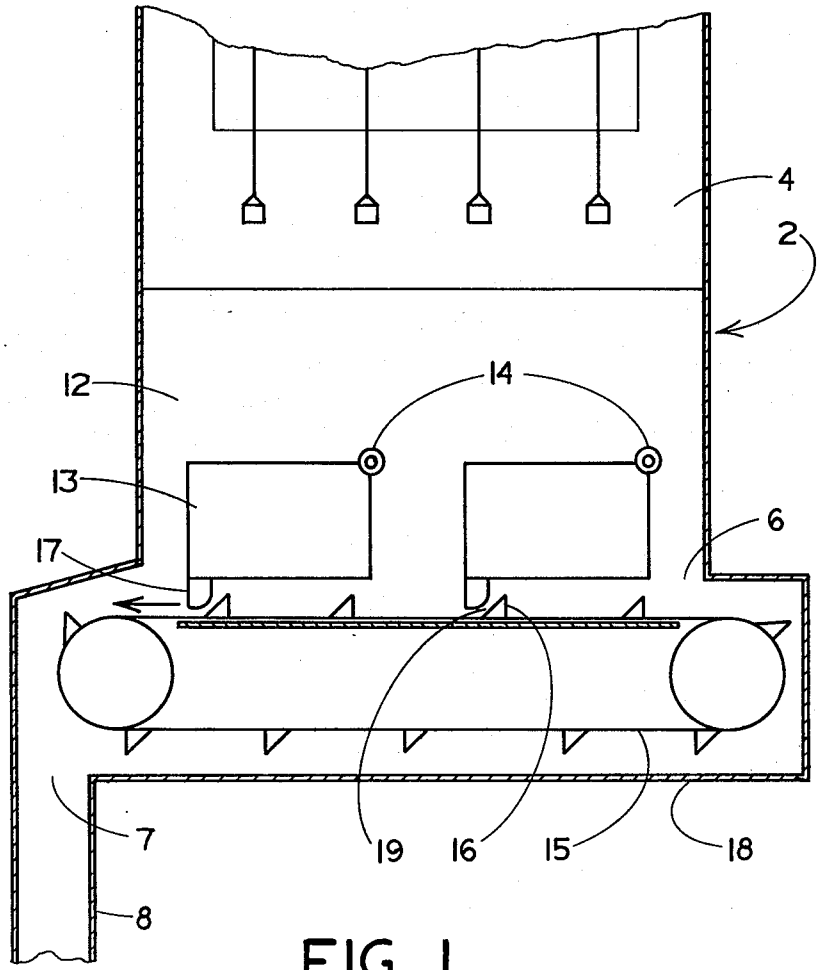

Referring to the drawings:

FIG. 1 is a sectional, elevational view, of one preferred anti-bridging device of the instant invention; and, FIG. 2 is a sectional, end view, of the anti-bridging device of the present invention as shown in FIG. 1.

In the Figures, a hopper, generally designated by the numeral 2, includes an upper inlet portion 4, and a lower outlet portion designated by the numeral 6 with inclined side walls 11 and 12, the inclined side walls 11 and 12 terminating in their downward direction to define the outlet portion 6. Disposed beneath the lower outlet portion 6 and attached thereto with an opening therein in flow communicating with the outlet 6 is a dust removing device which includes a housing 18 and an endless belt conveyor 15, endless belt conveyor 15 being provided with a plurality of cams 16 mounted thereon.

At one end of the housing 18 is an outlet designated by the numeral 7 which is a communication with a conduit 8 for removing dust from the housing 18.

Disposed along the inner surfaces of the side walls 11 and 12 is a plurality of anti-bridging members 13 disposed just above the outlet 6 of the hopper 2. The anti-bridging members 13 are generally rectangular shaped flat plate members and are pivotally attached to the sidewalls 11 and 12 by the pivots 14, pivots 14 being generally welded thereto. Anti-bridging members 13 are generally scrapers which rub or slide against the sidewalls 11 and 12. The positions of the pivots 14 are generally at one of the upper corners of the anti-bridging members or scrapers 13 so that the scrapers 13 can be moved in an hpward direction on contact with the cam members 16.

This means for moving the scrapers 13 in an upward direction 15 is generally accomplished by providing a tongue or lifter 17 at a corner of the scraper 13 opposed to the pivotally attached corner 14 wherein the tongue 17 is in contacting relation with the upwardly extending cam member 16 as member 16 passes underneath. The upwardly extending cam 16 is generally wedge-shaped with a slant side 19 of the wedge contacting the tongue 17 as the endless belt 15 moves past. The tongue 7 is shown as being rectangular with the lower corner which contacts the slant side of the wedge-shaped member 16 being rounded thereby preventing binding between the tongue 17 and the cam member 16.

The endless belt 15 may be any known in the art and is generally motor operated (not shown) and is movable in the direction noted by the arrow in FIG. 1.

In the operation of the anti-bridging device of the instant invention, upon movement of the endless belt 15 with the upwardly extending cam members 16 thereon, contact is made between the lifters 17 of the scrapers 13 with the cams 16 moving the scrapers 13 in an upward direction as the belt 15 passes therebeneath. As soon as the lifter 17 has completed contact with the apex of the upwardly extending member 16, the scraper or anti-bridging member 13 falls to its horizontal position thereby continually scraping the sidewalls 11 and 12 preventing build-up of solid materials at the outlet portion 6 of the hopper 2.

It is realized that various changes may be made to the specific embodiment shown and described without departing from the scope and spirit of the present invention.

What is claimed is:

1. A device for preventing bridging in a hopper, the hopper including an upper inlet portion and a lower outlet portion with inclined sidewalls disposed therebetween, said device comprising: at least one scraper disposed along at least one of said sidewalls with at least one upper corner pivotally attached at said one upper corner to said one sidewall of said hopper; and, dust moving means having at least one upwardly extending member, said upwardly extending member contacting said scraper during movement thereof whereby said scraper is moved upwardly by said member during contact therewith and downwardly after said contact therewith thereby preventing bridging of material at said lower outlet portion.

2. The device of claim 1, said dust moving means being an endless belt.

3. The device of claim 1, said scraper being a rectangular shaped flat plate member with a downwardly extending tongue disposed in contacting relation with said upwardly extending member.

4. The device of claim 3 wherein said rectangular shaped flat plate member is pivotally attached at one of its upper corners and said tongue is disposed at a corner opposed to said pivotally attached corner.

5. The device of claim 3 wherein said dust moving means is an endless belt, said upwardly extending member is wedge shaped, and said tongue is rectangular with one lower corner being rounded, said rounded corner being in contacting relation with the inclined side of said wedge-shaped member.

6. In combination with an electrostatic precipitator, a device for preventing bridging in a hopper, the hopper including an upper inlet portion in communication with a bottom opening of an electrostatic precipitator and a lower outlet position with inclined sidewalls disposed therebetween, the device comprising: at least one scraper disposed along at least one of said sidewalls with at least one upper corner pivotally attached at said one upper corner to said one sidewall of said hopper; and, means to contact and raise said scraper whereby said scraper is moved upwardly by said means during contact therewith and downwardly after said contact therewith; thereby preventing bridging of material at said lower outlet portion.

* * * * *